US006705057B2

(12) United States Patent
Smyer, III

(10) Patent No.: US 6,705,057 B2
(45) Date of Patent: Mar. 16, 2004

(54) MODULAR BLOCK SYSTEM AND METHOD OF CONSTRUCTION

(76) Inventor: Sidney W. Smyer, III, 6244 Amber Hills Rd., Trussville, AL (US) 35173

( * ) Notice: Subject to any disclaimer, the term of this patent is extended or adjusted under 35 U.S.C. 154(b) by 0 days.

(21) Appl. No.: 09/800,178

(22) Filed: Mar. 6, 2001

(65) Prior Publication Data

US 2002/0124509 A1 Sep. 12, 2002

(51) Int. Cl.[7] ..... E04B 5/04; E04B 2/00; E04C 2/04

(52) U.S. Cl. ..... 52/606; 52/607; 52/425; 52/439

(58) Field of Search ..... 52/605, 606, 607, 52/561, 425, 431, 437, 438, 439, 125.3, 125.4, 125.5

(56) References Cited

U.S. PATENT DOCUMENTS

| | | | | | |
|---|---|---|---|---|---|
| 498,891 | A | * | 6/1893 | Thompson | 52/125.4 |
| 869,770 | A | * | 10/1907 | Birnstock | 52/125.4 |
| 2,684,589 | A | * | 7/1954 | Perreton | 52/223.7 |
| 3,187,694 | A | | 6/1965 | Crookston et al. | |
| 3,417,533 | A | * | 12/1968 | Sparling | 52/591.2 |
| 3,760,540 | A | * | 9/1973 | Latoria et al. | 52/125.5 |
| 4,018,018 | A | | 4/1977 | Kosuge | |
| 4,075,808 | A | | 2/1978 | Pearlman | |
| 4,091,587 | A | * | 5/1978 | Depka | 52/421 |
| 4,510,725 | A | | 4/1985 | Wilson | |
| 4,514,949 | A | | 5/1985 | Crespo | |
| 4,771,584 | A | * | 9/1988 | Beard et al. | 52/596 |
| 4,833,852 | A | * | 5/1989 | West | 52/405.1 |
| 4,970,842 | A | * | 11/1990 | Kappeler et al. | 52/412 |
| 5,487,526 | A | | 1/1996 | Hupp | |
| 5,729,944 | A | | 3/1998 | De Zen | |
| 5,787,670 | A | * | 8/1998 | Muncy | 405/284 |
| 5,802,797 | A | * | 9/1998 | Storer-Folt | 52/604 |
| 5,881,524 | A | * | 3/1999 | Ellison, Jr. | 52/565 |
| 6,032,424 | A | * | 3/2000 | Dial, Jr. | 249/96 |
| 6,189,282 | B1 | * | 2/2001 | VanderWerf | 52/582.1 |
| 6,539,684 | B1 | * | 4/2003 | Graham | 52/609 |

* cited by examiner

*Primary Examiner*—Carl D. Friedman
*Assistant Examiner*—Kevin McDermott
(74) *Attorney, Agent, or Firm*—Bradley Arant Rose & White LLP

(57) ABSTRACT

A construction block, bed gasket and butt gasket are described, as well as a unique construction method for constructing a construction array utilizing the construction blocks and gaskets. The construction blocks comprise a first and second load bearing faces, first and second engaging faces, an inner face and an outer face, which faces define a block passage, as well as at least one lifting rod to aid in assembly of the construction array. The construction method utilizes bed gasket and butt gasket to provide for ease of assembly of the construction blocks, as well as other benefits.

12 Claims, 6 Drawing Sheets

MODULAR BLOCK SYSTEM AND METHOD OF CONSTRUCTION

FIELD OF INVENTION

The present disclosure relates to construction blocks and a system of construction utilizing the construction blocks. More specifically, the disclosure relates to a specialized construction block, construction block engaging gaske and a system of construction utilizing the construction blocks and gaskets.

BACKGROUND

Over the centuries, construction blocks of various shapes and sizes have been a mainstay in the construction of various structures and dwellings. Ancient builders used building blocks hewn from solid stone. In most cases, the predominate shape of these construction blocks has been the rectangle, or a variation thereof. In other cases the shape of the block is dictated by the architectural function for which the block is needed. For instance an arch or lintel is needed to create a window opening and a cornice is needed to protrude out from the plane of the exterior wall in order to direct rainwater away from the building. Yet in nearly all cases, the faces of each adjacent block are flat and in parallel planes. Structures built using these construction blocks had the advantage of durable construction, as is evidenced by the conditions of many archeological monuments today.

Over the ages, builders have continued the tradition of carving and fabricating construction blocks from a variety of materials. Today, construction blocks are typically formed as bricks, concrete blocks, cinder blocks and tiles. Today's modern construction blocks have the added benefits that in addition to being very durable, the construction blocks are relatively inexpensive to manufacture, can be manufactured in mass quantities for relatively uniform installation and are virtually maintenance free.

One trend in the construction industry is the use of construction blocks with architecturally finished details for building construction and specialized architectural structures, such as free standing walls, arches, cornices, columns, pilasters, jambs, beams, ceilings, floors, chimney pieces, tiers, brackets, capitals and other special structures. Through the use of these construction blocks, structures can be created with a finished appearance, as wells as structures that require less materials and labor to produce an aesthetically pleasing result. As a result, significant cost savings can be realized. In addition, these specialized construction blocks are often formed with interior chambers that form a hollow internal network in the finished structure. This internal network can be utilized in various manners. For instance, if added strength is desired, the internal network can be filled with concrete in order to secure the blocks together. If increased insulating properties are desired, the internal network can be filled with an insulating foam. Alternatively, a mixture of insulating material and cement can be introduced into the hollow internal network to add both strength and insulation at once.

Despite the advances in construction block manufacture and composition, the method of construction block installation has remained essentially the same over the years. Skilled workers must arrange and align individual blocks in the construction array to form the completed structure while applying mortar or other material to seal the joints between the blocks to create a finished appearance. However, despite modern techniques for construction block production, it is impossible to mass produce the blocks with 100% accuracy. As a result, slight variations in the vertical and horizontal dimensions of the construction blocks occur. As a result, workers on the site must manipulate the construction blocks to achieve an optimal alignment between the construction blocks that make up the structure to create a uniform mortar joint. As many of the construction blocks used today are bulky and heavy, this manipulation process can be time consuming and arduous, and can even result in injury to workers.

Therefore, construction materials and a method of construction are needed that allow for the efficient and cost effective construction of an aesthetically pleasing and structurally sound finished structure. Through the of the construction blocks, gaskets and method described in the present disclosure, a user will be able to cost-effectively produce a finished structure with consistent joint spaces between the construction blocks, while at the same time compensating for minor irregularities in the engaging faces of the construction blocks.

DESCRIPTION

Figure 1:
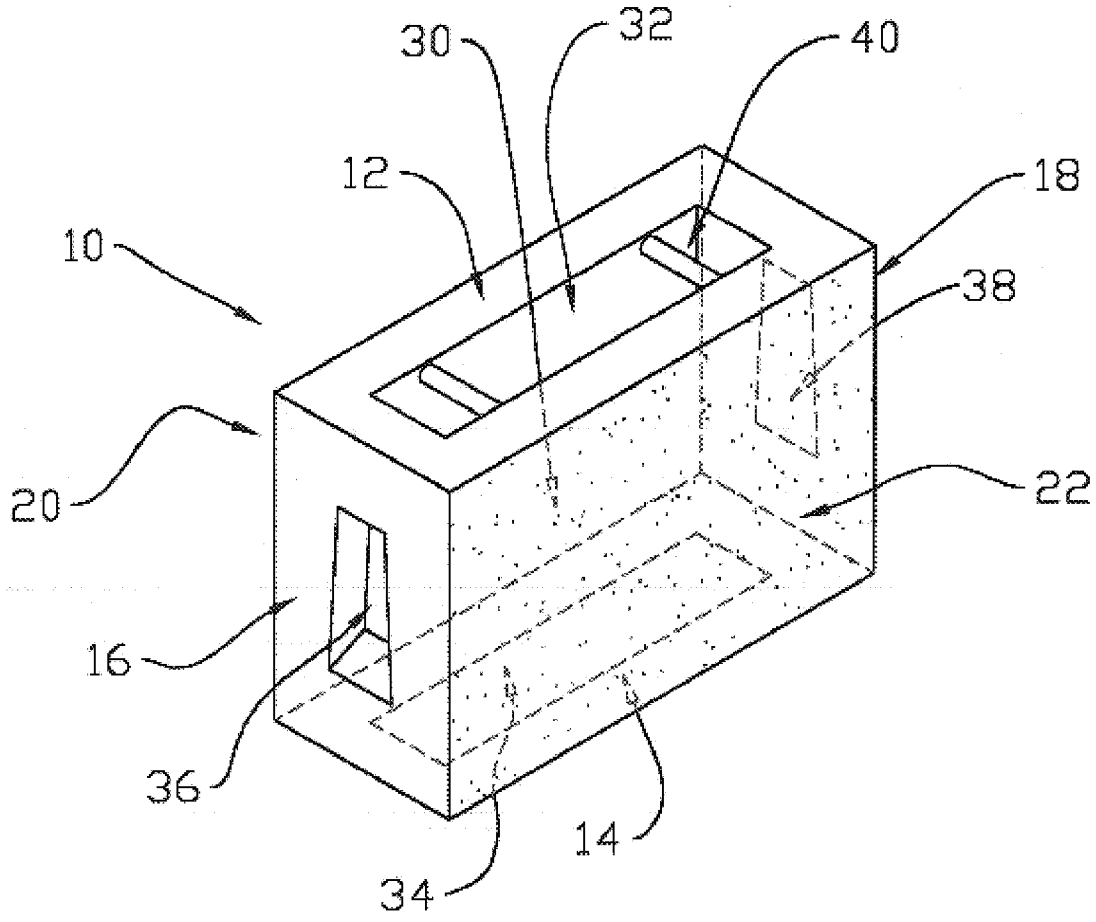
FIG. 1 is a three-dimensional view illustrating an embodiment of the construction block described herein.

The following terms should be given the following meanings in the specification and attached claims:

- a bed joint shall mean the structure, typically in the horizontal plane, formed when any two load bearing faces of two or more construction blocks are positioned adjacent to one another in a construction array;
- a butt joint shall mean the structure, typically in the vertical plane, formed when any two engaging faces of two or more construction blocks are positioned adjacent to one another in a construction array;
- a construction array shall mean any two or three dimensional configuration of construction blocks, regardless of the pattern of construction, useful in creating a structure;
- a construction block shall mean any block or other material suitable for use in forming a construction array, regardless of the shape, size or composition of the block or material; and
- a structure shall mean any article manufactured from a construction array such as, but not limited to, interior and/or exterior walls, arches, cornices columns, pilasters, jambs, beams, ceilings, floors, chimney pieces, tiers, brackets, capitals, free-standing walls and any architectural details needed to create the same;

FIG. 1 illustrates a construction block 10 typical of the present disclosure. The block is shown as generally rectangular in shape. As is the standard in design of construction blocks, the block 10 has 6 sides, or faces: a first load bearing face 12 (the upper face), a second load bearing face 14 (lower face), a first engaging face 16 and a second engaging face 18 (the side faces), and an interior face 20 and an exterior face 22. The interior of the block 10 may be solid, or may be hollow. In the instance where the interior of the block 10 is hollow, the first 12 and second 14 load bearing faces, the first 16 and second 18 engaging faces and the interior 20 and exterior 22 faces define at least one block passage 30 in the interior of the block 10. The block passage 30 may extend throughout the vertical length of the block 10, as defined by the length of the first 16 and second 18 engaging faces, to create top 32 and bottom 34 openings, or may terminate before extending throughout the vertical length of block 10, creating only a top opening 32, or only a bottom opening 34. In addition, there may be additional side openings 36 and 38 in the engaging faces 16 and 18, extending into the block passage 30.

FIG. 1 shows block 10 with one block passage 30, a top opening 32, a bottom opening 34 and two side openings 36 and 38. The top 32, bottom 34, and side 36 and 38 openings allow the formation of an internal network in the construction array. Through this internal network, any given block opening in one construction block may communicate with any other block opening in an adjacent construction block in the construction array if the blocks 10 are in proper allignment. This communication allows the construction blocks in the construction array to receive concrete to reinforce the array, or insulating material to provide superior insulating properties to the construction array, or an insulating concrete providing both reinforcement and insulation.

Figure 1A:
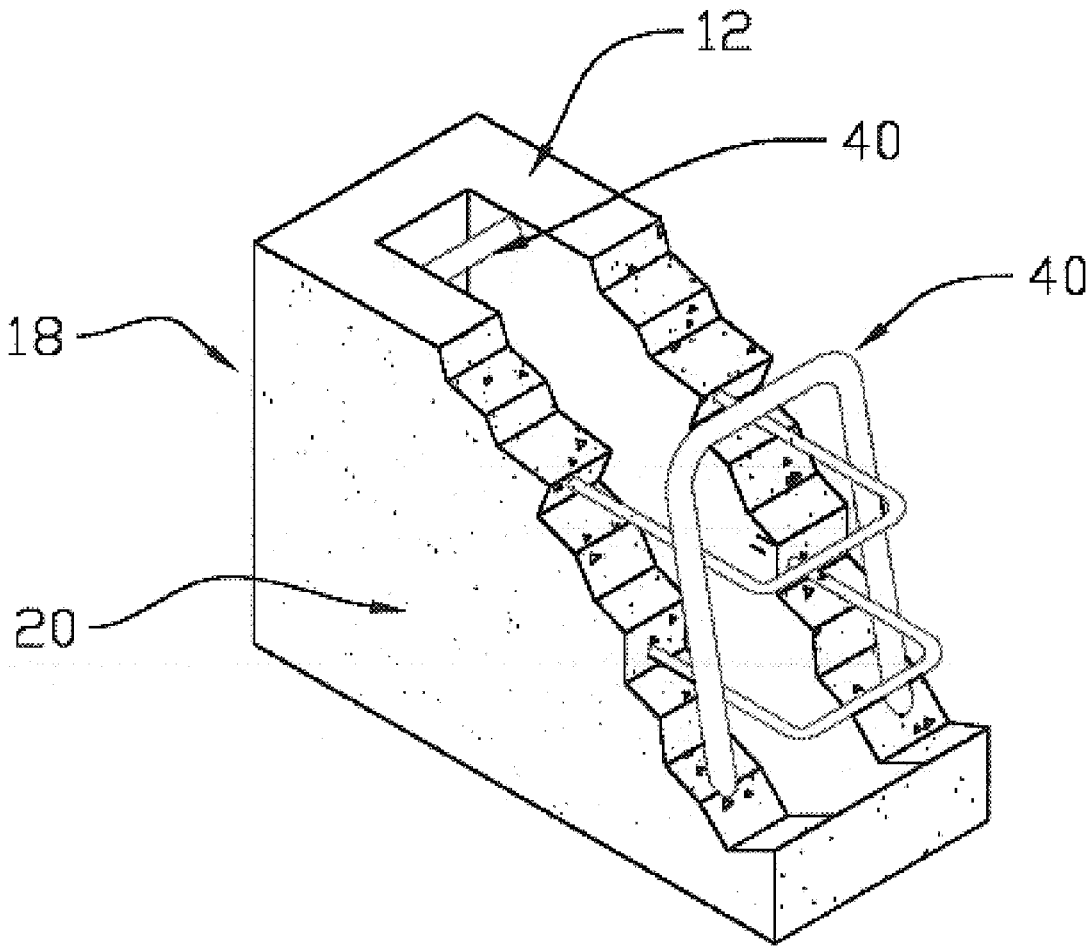
FIG. 1A is a cutaway view of the block of FIG. 1 further illustrating the lifting rods.

FIGS. 1 and 1A also illustrates the lifting rod 40. The lifting rod 40 is designed to aid in the placement of the construction block 10 into the construction array. For example, a crane or other lifting device, can be used to lift and move the construction block into an initial alignment. This is particularly advantageous when heavy construction blocks are used that are too heavy to be easily manipulated manually. The number and placement of the lifting rod(s) 40 is dependent on the size and structure of the particular construction block 10 used. The number and placement of the lifting rod(s) 40 is such that a the weight of the construction block can be supported by the lifting rods 40 and the construction block 10 can be transported into its initial alignment in the construction array. The lifting rod(s) 40 may be fashioned from any material capable of supporting the weight of construction block 10, such as steel. In addition, the lifting rod(s) 40 serve as reinforcing members of the construction block 10 and of the construction array if material is introduced into the block passage 30. In order to minimize interference during block construction, the lifting rod(s) 40 are contained between the planes formed by the first 12 and second 14 load bearing faces of the construction block.

The lifting rod(s) 40 may extend from any one face of the construction block to a different face of the construction block, thereby extending across the block passage 30. Alternatively, the lifting rod(s) 40 may extend from any one face of the construction block to the same face of the construction block, without extending completely across the block passage 30. In this embodiment, the lifting rod(s) 40 form a closed configuration, with both ends of the closed configuration being secured in the same face of the construction block.

FIGS. 1 and 1A show an embodiment of block 10 with two lifting rods 40. The lifting rods 40 are shown extending from within the interior side of the inner face 20 to within the interior side of the outer face 22. In this embodiment the lifting rods 40 extend across the block passage 30. However, the lifting rods 40 may be positioned so that they extend from within any one face of the construction block 10 to any other face of construction block 10. Alternatively, the lifting rods 40 may simply be a closed configuration extending from within one or more faces of construction block 10 without extending into any other face of construction block 10. For example, the lifting rods 40 may be one or more loop structures embedded within the inner 20 and/or outer 22 faces without extending completely across the block passage 30.

The corners of construction block 10, which are formed by the intersection of the six faces of the block 10 described above, are substantially right angles. The presence of right angles on the construction block 10 simplifies the production process for the blocks 10, decreasing the unit cost of the finished blocks. Prior construction blocks have incorporated beveled corners. These beveled corners were required to form an opening to receive mortar, or other material, to seal the joints between the construction blocks in the construction array and to present a professional appearance to the finished structure. The construction blocks 10, when used in the construction method to be described below, obviate the requirement for beveled corners through the use of bed gaskets and butt gaskets (described below) at the block joints. The spacing between adjacent blocks created by these gaskets forms a uniform opening to receive the mortar, or other material, along the exterior edge of the gasket. The uniformity of the opening has the added advantage that a finished, professional joint is produced once the mortar, or other material, is applied.

Figure 2:
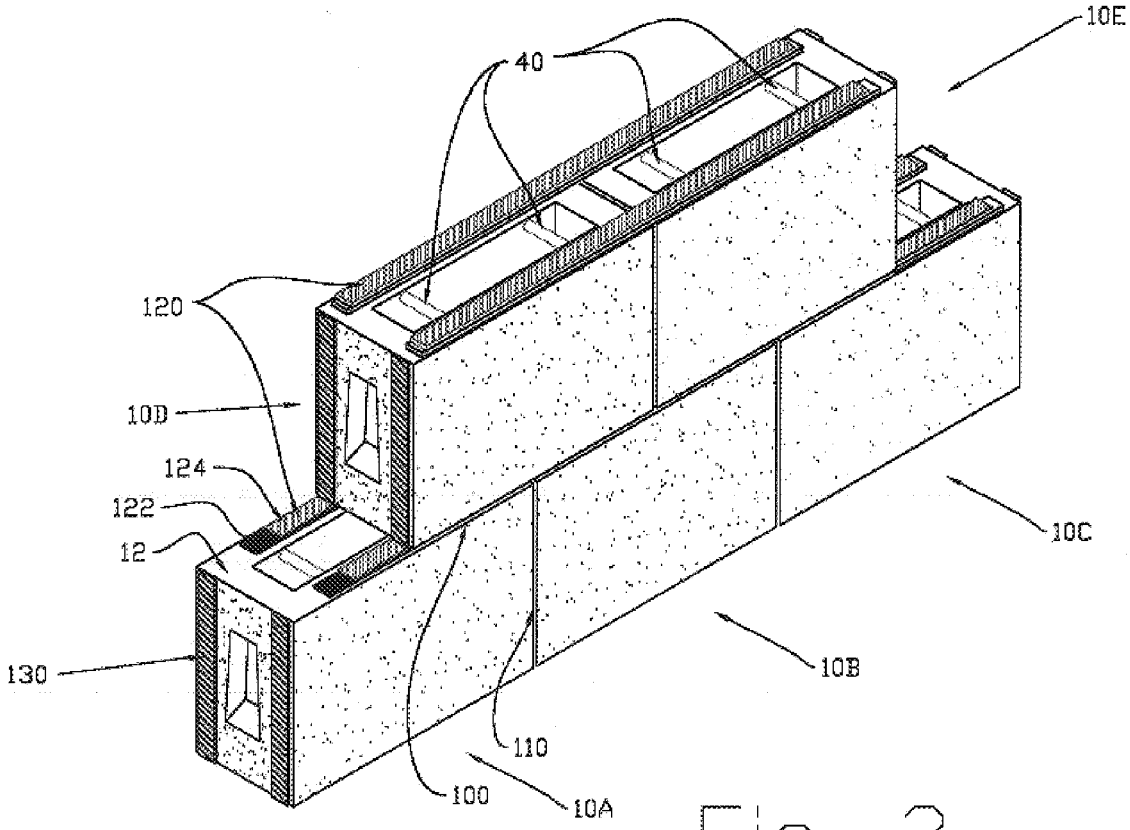
FIG. 2 is a three-dimensional view illustrating the construction of a construction array using the blocks, gaskets and construction method described herein.

The present disclosure also teaches a unique method which utilizes the construction blocks and gaskets taught by the present disclosure to form a construction array. The construction blocks may be arranged in the array in any manner desired. FIG. 2 shows an illustrative construction array to exemplify the novel construction method, illustrating a staggered configuration of blocks. The first course of construction blocks in the array is shown as blocks 10A, 10B and 10C. The second course of construction blocks in the array is shown as blocks 10D and 10E. The juxtaposition of blocks 10A, 10B, 10C, 10D and 10E in the construction array forms the bed joints 100 and the butt joints 110. Aside from mortar or other material, generally in the construction methods taught by the prior art, there is no physical barrier separating the construction blocks comprising the first course and the construction blocks comprising the second course of the array. As a result, once a large construction block is initially positioned in the array, it is difficult to adjust the block to attain optimal alignment for final positioning within the array due to the frictional forces generated as the blocks grate against one another.

The present disclosure teaches the placement of bed gasket 120 between the construction blocks forming the bed joints 100 and a butt gasket 130 between the construction blocks forming the butt joints 110. The bed gasket 120 serves several different functions, including correcting small irregularities in the load bearing surfaces 12 of the construction blocks 10A–10E incorporated into the construction array, absorbing and dissipating small shocks to the structure, and allowing the efficient manipulation of construction blocks in the construction array. Therefore, the bed gasket 120 can be any device which provides the following:

1. one face to provide for increased frictional characteristics and compressibility, allowing the bed gasket to adhere to the first load bearing faces 12 of the construction blocks in lower course of the construction array, to correct any irregularities in the first load bearing faces 12 and to provide a mechanism to absorb shock to the structure; and 2. one face to provide for decreased frictional characteristics, allowing the second load bearing faces 14 of the construction blocks in the upper course of blocks to slide against the bed gasket.

Figure 3:
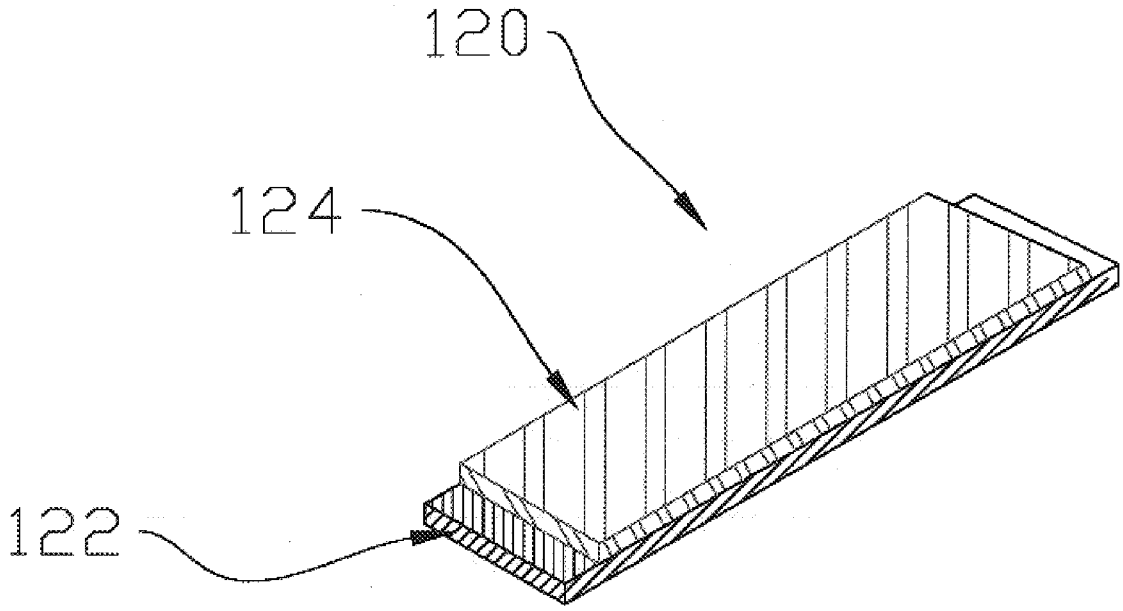
FIG. 3 is a partial cutaway view of an embodiment of the bed gasket described herein.

FIG. 3 illustrates a bed gasket 120. The bed gasket 120 comprises two faces, a lower face 122 which provides increased frictional characteristic, and an upper face 124, which provides for decreased frictional characteristics. It is preferred that the material comprising the lower face 122 be compressible under the weight of the construction block 10, while the material comprising the upper face 124 be resistant to compression under the weight of the construction blocks 10. In this embodiment, the lower face 122 and the upper face 124 comprise two distinct materials which are bonded together to form the finished bed gasket 120. The inventors have found that neoprene rubber as the lower face 122 and high-density plastics as the upper face 124 act as a superior bed gasket 120, but bed gasket 120 may comprise different materials. For example, alternate materials for the lower face 122 include, but are not limited to, natural rubber, synthetic rubber compositions, expanded polystyrene, neoprene, cotton webbing and carpet. Alternate materials for the upper face 124 include, but are not limited to, low and medium-density plastic, steel, other metals and hardwoods. In addition both the upper face 124 and the lower face 122 may incorporate faces with only decreased frictional characteristics.

Bed gasket 120 may also be of unitary construction, providing the bed gasket 120 is composed of material capable of providing a lower face 122 with increased frictional characteristics and an upper face 124 with decreased frictional characteristics as described above. Alternatively, the bed gasket 120 may be of a 3-layer construction, with the lower face and upper face being composed of a material providing decreased frictional characteristics as described for the lower face 122, and the middle layer being composed of a material, such as, but not limited to low and medium-density plastic, steel, other metals and hardwoods, to impart strength to the bed gasket 120. These two embodiment of the bed gasket 120 may be useful when the decreased frictional characteristics described above for the upper face 124 are not required (such as the case when smaller construction blocks are being used).

Figure 4:
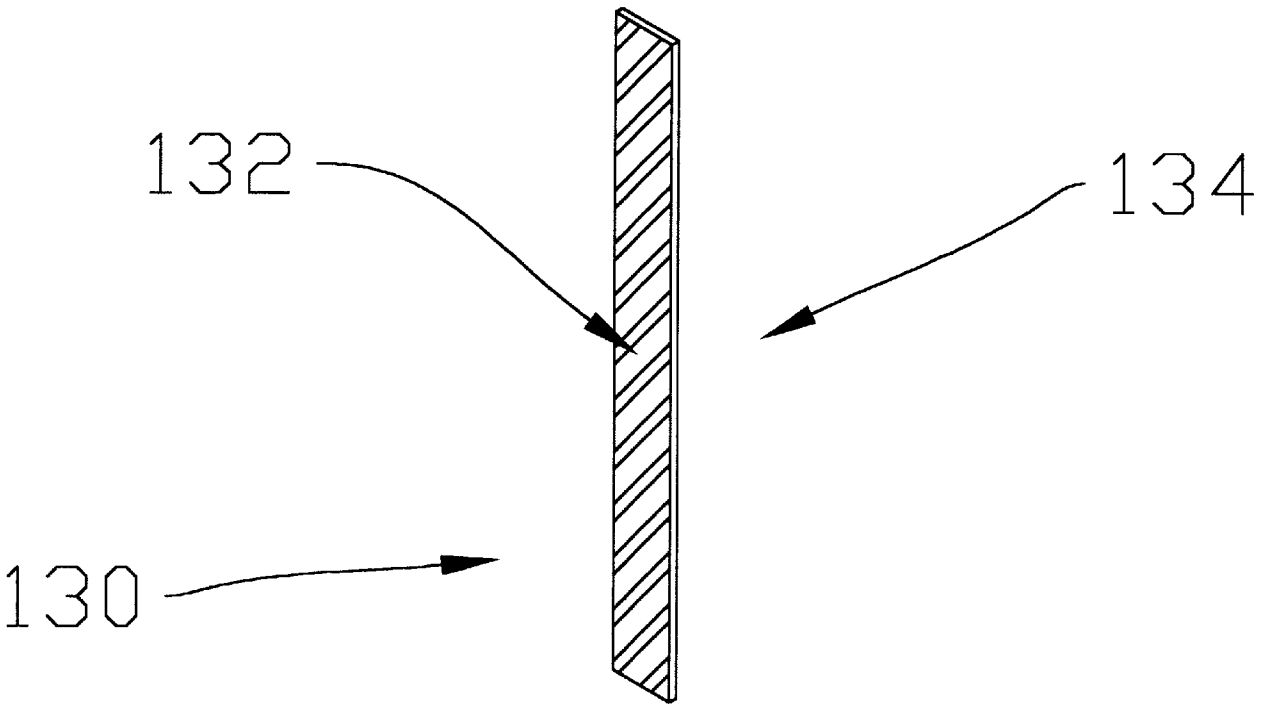
FIG. 4 is a view of an embodiment of the butt gasket described herein.

The butt gasket 130 may also incorporate faces with increased and decreased frictional characteristics as described above for the bed gasket 120, but alternatively, may incorporate faces with only decreased frictional characteristics and shock absorbing properties. FIG. 4 illustrates one embodiment of butt gasket 130. In this embodiment, the butt gasket 130 comprises a lower face 132 and an upper face 134, both providing decreased frictional characteristics. The butt gasket 130 may be manufactured from the same materials as the lower face 122 of the bed gasket 120, or may be composed of a different material.

The bed 120 and butt 130 gaskets can be of varying size and thickness depending on the construction block used. The thickness and/or width of the bed 120 and butt 130 gaskets may increase as the size of the construction block increases. Additionally, the thickness and/or width of the bed 120 and butt 130 gaskets may increase or decrease in order to produce a joint of the desired width, the width of the joint being dictated by aesthetic and structural requirements. The composition of the bed 120 and butt 130 gaskets may also vary depending on the size of the construction block used. These modifications are well within one of ordinary skill in the art in the construction field.

Again referring to FIG. 2, this embodiment illustrates the placement of bed gaskets 120 and butt gasket 130 in the construction array. Bed gasket 120 is placed on the first load bearing faces 12 of blocks 10A, 10B and 10C, with the lower face 122 contacting first load bearing faces 12 of said blocks. In this configuration, the decreased frictional characteristics of lower face 124 allow bed gasket 120 to engage the load bearing faces 12 of blocks 10A, 10B and 10C. The construction blocks of the second course (blocks 10D and 10E in FIG. 3) of the construction array are now ready to be placed in the array. Blocks 10D and 10E are placed so that the upper face 124 of bed gasket 120 engages the second load bearing faces 14 (as shown in FIG. 1) of blocks 10D and 10E. As a result, bed gasket 120 will not move significantly from its original position when blocks 10D and 10E are placed on the bed gasket 120 due to the increased frictional characteristics of the lower face 122 of bed gasket 120. Furthermore, blocks 10D and 10E can be easily manipulated by workers by sliding the blocks 10 along the upper face 124 due to the decreased frictional characteristics of the upper face 124 of bed gasket 120.

Figure 5:
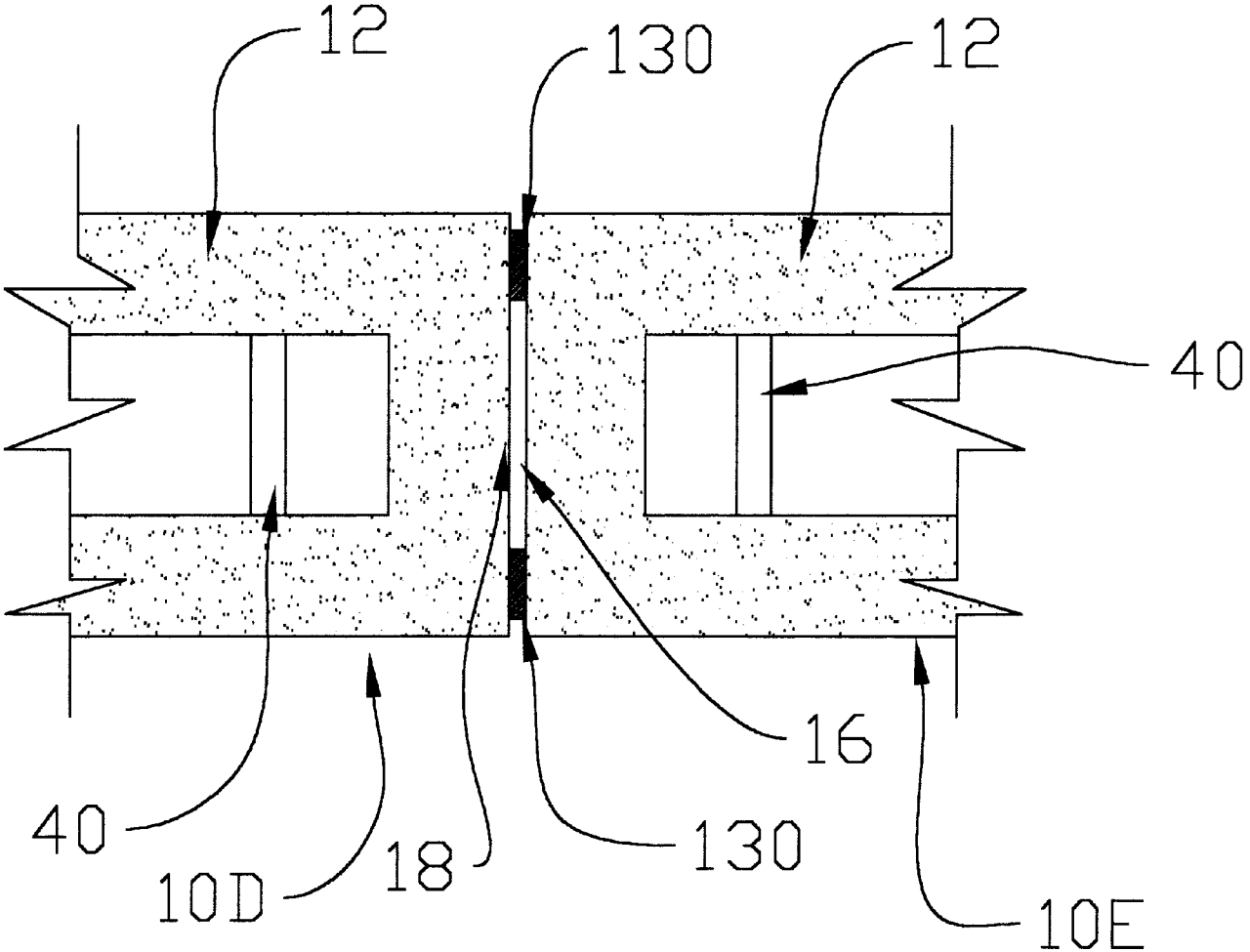
FIG. 5 is plan view of two blocks of the construction array of FIG. 3 illustrating one possible placement of the butt gasket.

Also illustrated in FIG. 2 is butt gasket 130. Butt gaskets 130 are placed between the engaging faces of the blocks in the construction array. Specifically, butt gaskets 130 are placed between the vertical engaging faces 18 of the construction blocks 10A–10E of the construction array. FIG. 5 further illustrates the placement of the butt gaskets 130. FIG. 5 is a top view of the butt joint 110 formed by blocks 10D and 10E in FIG. 2. Two butt gaskets 130 are shown positioned between the second engaging face 18 of block 10D and the first engaging face 16 of block 10E. The two butt gaskets 130 are positioned vertically along the outer edges of the engaging faces 16 and 18, although positioning horizontally across the top and bottom the engaging faces 16 and 18 is an option.

Although the above discussion specifically described the placement of bed gaskets 120 and butt gaskets 130 in a simply construction array, the same principles can be applied for use in any construction array to achieve the benefits described.

The novel construction method described herein provides many benefits not heretofore appreciated in the art. As described above, using the system described, workers will be able to easily manipulate even construction blocks of large size with greatly reduced effort by virtue of the reduced frictional characteristics of the upper face of the bed gaskets. This is accomplished because the construction blocks can slide along the upper surface of the bed gasket, which greatly reduces the friction encountered when sliding the construction blocks against each other. This offers the advantages of decreased construction times (and therefore, reduced labor cost) and decreased risk of worker injury. In addition, the result is a more aesthetically pleasing finished product, since finer manipulation of the construction blocks is possible allowing optimal final placement of the blocks. The use of the bed and butt gaskets will also provide for a more uniform mortar joint throughout the finished structure. This uniform mortar joint can be provided using construction blocks with perpendicular corners as described above. As a result, the construction blocks can be manufactured without beveled corners, reducing the cost of producing the blocks, and reducing the variations of block types that must be produced.

The bed gaskets and butt gaskets also provide a cushion between the construction blocks in the construction array by virtue of the composition of the gaskets themselves. As described above, the lower face of the bed gasket and the butt gasket are composed of material that offers many of the same properties as rubber, and may be composed of rubber. Therefore, the gaskets provide an amount of structural cushioning and shock absorption without interfering with the structural characteristics of the finished structure. The bed and butt gaskets will also provide a type of seal between the construction blocks in the finished structure. This extra seal will give superior insulating characteristics to the finished structure, as well as providing an additional barrier to liquid penetration.

The description is intended to be illustrative of the construction blocks and system of construction described herein. It should be appreciated that various modifications could be made in the construction blocks, gaskets and system of construction utilizing the construction blocks and gaskets which remain within the scope and teaching of the instant disclosure. The details given herein are to be interpreted as illustrative only and not in a limiting sense.

What I claim:

1. A system of constructing a construction array comprising:

a. utilizing a plurality of construction blocks to form a construction array, the blocks comprising a first and a second load bearing face, a first and a second engaging face, an inner face and an outer face;

b. placing at least one bed gasket between the first load bearing face of at least one block and the second load bearing face of at least one block in the construction array; and c. said bed gasket having a lower face which comprises a material which provides for decreased frictional characteristics in contact with said first load bearing face and an upper face which comprises a material which provides for increased frictional characteristics in contact with said second load bearing face.

2. The system of claim 1 where the construction blocks further comprise:

a. at least one block passage defined by the first and second load bearing faces, the first and second engaging faces, the inner face and the outer face, the block passage extending throughout at least a portion of the length of the inner and outer faces, the at least one block passage comprising at least one of a top opening and a bottom opening.

b. at least one side opening communicating with the at least one block passage; and c. at least one lifting rod extending directly from at least one of the said faces of the construction block to a different face of the construction block, the at least one lifting rod being contained within the planes formed by the first and second load bearing faces and the inner and outer faces of the construction block.

3. The system of clam 2 where at least some of the construction blocks of the construction array are positioned so that the block passage of one block is in communication with block passage of another block in the construction array and at least one side opening of one block is in communication with at least one side opening of another block in the array.

4. The system of claim 3 where material is poured through at least one block passage of one block in the construction array.

5. The system of claim 4 where the material is selected from the group consisting of: concrete, an insulating agent and a mixture of concrete and an insulating agent.

6. The system of claim 5 where the bed gasket is placed so that is does not interfere with the pouring of material through the at least one block passage.

7. The system of claim 1 further comprising:

a. placing a butt gasket between the first engaging face of at least one block and the second engaging face of at least one block in the construction array said butt gasket, a lower face which comprises a material which provides for decreased frictional characteristics in contact with said first engaging face and an upper face which comprises a material which provides for increased frictional characteristics in contact with said second engaging face.

8. The system of claim 7 where the construction blocks further comprise:

a. at least one block passage defined by the first and second load bearing faces, the first and second engaging faces, the inner face and the outer face, the block passage extending throughout at least a portion of the length of the inner and outer faces, the at least one block passage comprising at least one of a top opening and a bottom opening.

b. at least one side opening communicating with the at least one block passage; and c. at least one lifting rod extending directly from at least one of the said faces of the construction block to a different face of the construction block, the at least one lifting rod being contained within the planes formed by the first and second load bearing faces and the inner and outer faces of the construction block.

9. The system of clam 8 where at least some of the construction blocks of the construction array are positioned so that the block passage of one block is in communication with block passage of another block in the construction array and at least one side opening of one block is in communication with at least one side opening of another block in the array.

10. The system of claim 9 where material is poured through at least one block passage of one block in the construction array.

11. The system of claim 10 where the material is selected from the group consisting of: concrete, an insulating agent and a mixture of concrete and an insulating agent.

12. The system of claim 11 where the bed gasket and the butt gasket are placed so that they do not interfere with the pouring of material through the at least one block passage.

* * * * *